US010151568B2

(12) United States Patent
McAllister et al.

(10) Patent No.: US 10,151,568 B2
(45) Date of Patent: Dec. 11, 2018

(54) GUIDED PROJECTILE AND METHOD OF ENABLING GUIDANCE THEREOF

(71) Applicant: The Boeing Company, Chicago, IL (US)

(72) Inventors: Edward McAllister, Chesterfield, MO (US); Keith Rackers, Florissant, MO (US); Ledjan Qato, St. Louis, MO (US); Ryan Glen Binkholder, Webster Groves, MO (US); Vincent Wayne Klakovich, St. Charles, MO (US)

(73) Assignee: The Boeing Company, Chicago, IL (US)

( * ) Notice: Subject to any disclaimer, the term of this patent is extended or adjusted under 35 U.S.C. 154(b) by 479 days.

(21) Appl. No.: 15/070,252

(22) Filed: Mar. 15, 2016

(65) Prior Publication Data

US 2017/0268855 A1 Sep. 21, 2017

(51) Int. Cl.
*F42B 10/14* (2006.01)
*F42B 12/76* (2006.01)

(52) U.S. Cl.
CPC ..... *F42B 10/14* (2013.01); *F42B 12/76* (2013.01)

(58) Field of Classification Search
CPC ..... F42B 10/14; F42B 12/76
See application file for complete search history.

(56) References Cited

U.S. PATENT DOCUMENTS 3,333,540 A * 8/1967 Clark ..... F42B 12/68 102/400
4,351,499 A * 9/1982 Maudal ..... F42B 10/146 244/3.27
4,568,044 A * 2/1986 DiTommaso ..... F42B 10/146 244/3.27
4,586,680 A * 5/1986 DiTommaso ..... F42B 10/146 244/3.27
4,712,465 A 12/1987 Macdonald
4,869,442 A * 9/1989 Miller ..... F42B 10/14 244/3.28
5,615,847 A * 4/1997 Bourlett ..... F42B 10/14 114/316
6,446,906 B1 * 9/2002 Voigt ..... B64C 9/36 244/3.27

(Continued)

OTHER PUBLICATIONS

Lockheed Martin Navy 5-Inch Guided Projectile; available at http://www.lockheedmartin.com/us/products/navy-5-inch-guided-projectile.html; last visited Mar. 9, 2016.

(Continued)

*Primary Examiner* — Richard R. Green
*Assistant Examiner* — Michael B. Kreiner
(74) *Attorney, Agent, or Firm* — Armstrong Teasdale LLP

(57) ABSTRACT

A guided projectile that includes a warhead case, a cartridge case coupled to the warhead case, and a tail kit assembly positioned within the cartridge case. The tail kit assembly includes a hollow casing including a plurality of fin slots defined therein, a control fin selectively extendable from within the hollow casing through each fin slot of the plurality of fin slots, and a fin slot cover positioned within each fin slot with a minimum clearance fit such that the control fin is retained within the hollow casing. The fin slot cover is releasable from within each fin slot such that the control fin is deployable therethrough.

16 Claims, 4 Drawing Sheets

(56) References Cited

U.S. PATENT DOCUMENTS

| | | | | |
|---|---|---|---|---|
| 6,880,780 | B1 * | 4/2005 | Perry | F42B 10/14 244/3.27 |
| 7,829,830 | B1 * | 11/2010 | Rogers | F42B 10/20 244/3.27 |
| 8,895,908 | B2 * | 11/2014 | Barry | F42B 39/00 244/117 R |
| 9,012,825 | B2 * | 4/2015 | Plumer | F42B 10/14 244/3.1 |
| 9,593,922 | B2 * | 3/2017 | Carlson | F42B 10/16 |
| 2014/0312160 | A1 * | 10/2014 | Blake | F41F 3/077 244/3.1 |

OTHER PUBLICATIONS

Bae Systems 5" Multi Service Standard Guided Projectile; available at http://www.baesystems.com/en-us/product/5-multi-service-standard-guided-projectile; last visited Mar. 9, 2016.

* cited by examiner

GUIDED PROJECTILE AND METHOD OF ENABLING GUIDANCE THEREOF

BACKGROUND

The field of the present disclosure relates generally to guided projectiles and, more specifically, to a space-saving tail kit assembly for use in guided projectiles.

Many known traditional gun-launched projectiles include a warhead case and a cartridge case coupled to the warhead case. The warhead case typically houses an ordinance, and the cartridge case typically houses a propellant and a charge primer that, when activated, causes the projectile to be discharged from a launcher. With the development of gun-launched guided projectiles, internal guidance avionics and control fin actuators are also housed within the cartridge case. Sensitive components such as the internal guidance avionics and control fin actuators are generally unable to withstand harsh gun-propelling charge pressures and resulting contamination, and thus need to be protected therefrom.

At least some known guided projectiles house the sensitive components within a hollow casing of a tail kit assembly, and the tail kit assembly is protected with an aft-mounted protective cup. The protective cup typically has an internal draft angle, which enables it to be discarded during the discharge cycle of the guided projectile. More specifically, the internal draft angle enables the protective cup to slip off the tail kit assembly once exiting a muzzle of the launcher and entering the free air stream. However, the internal draft angle also reduces a volume within the hollow casing for storing sensitive components therein. Moreover, the protective cup adds sacrificial weight to the guided projectile and presents a risk of foreign object damage once released from the tail kit assembly.

BRIEF DESCRIPTION

In one aspect, a guided projectile is provided. The guided projectile includes a warhead case, a cartridge case coupled to the warhead case, and a tail kit assembly positioned within the cartridge case. The tail kit assembly includes a hollow casing including a plurality of fin slots defined therein, a control fin selectively extendable from within the hollow casing through each fin slot of the plurality of fin slots, and a fin slot cover positioned within each fin slot with a minimum clearance fit such that the fin slot cover is retained within the fin slot and the control fin is retained within the hollow casing. The fin slot cover is releasable from within each fin slot such that the control fin is deployable therethrough.

In another aspect, a tail kit assembly for use with a guided projectile is provided. The tail kit assembly includes a hollow casing including a plurality of fin slots defined therein, a control fin selectively extendable from within the hollow casing through each fin slot of the plurality of fin slots, and a fin slot cover positioned within each fin slot with a minimum clearance fit such that the fin slot cover is retained within the fin slot and the control fin is retained within the hollow casing. The fin slot cover is releasable from within each fin slot such that the control fin is deployable therethrough.

In yet another aspect, a method of enabling guidance of a guided projectile is provided. The method includes loading the guided projectile into a projectile launcher. The guided projectile includes a hollow casing, a control fin selectively extendable from within the hollow casing through a fin slot defined in the hollow casing, and a fin slot cover positioned within the fin slot with a minimum clearance fit such that the fin slot cover is retained within the fin slot and the control fin is retained within the hollow casing. The method also includes inducing a centrifugal force to the fin slot cover such that the fin slot cover is released from the hollow casing, and such that the control fin is deployed from within the hollow casing.

DETAILED DESCRIPTION

The implementations described herein relate to a space-saving tail kit assembly for use in guided projectiles. More specifically, the tail kit assembly described herein includes a hollow casing having a plurality of fin slots defined therein, a control fin selectively extendable through each fin slot of the plurality of fin slots, and a fin slot cover positioned within each fin slot with a minimum clearance fit such that the fin slot cover is retained within the fin slot and the control fin is retained within the hollow casing. When assembling the guided projectile, the fin slot cover is capable of retaining the control fins within the hollow casing. The fin slot cover also facilitates sealing sensitive components, such as guidance avionics, housed within the hollow casing from a high-pressure event when a propellant is ignited. Upon being discharged from a projectile launcher, a centrifugal force induced by rotation of the guided projectile causes the fin slot covers to be released from the fin slots, which enables the control fins to be deployed from within the hollow casing. As such, each control fin is individually retained and housed within the hollow casing, which facilitates increasing an internal volume of the hollow casing when compared to other known retaining systems. Moreover, the mass of the individual fin slot covers is less than other known sealing/retaining devices, which reduces the possibility of foreign object damage to adjacent personnel and structures.

As used herein, an element or step recited in the singular and proceeded with the word "a" or "an" should be understood as not excluding plural elements or steps, unless such exclusion is explicitly recited. Furthermore, references to "exemplary implementation" or "one implementation" of the present disclosure are not intended to be interpreted as excluding the existence of additional implementations that also incorporate the recited features.

Figure 1:
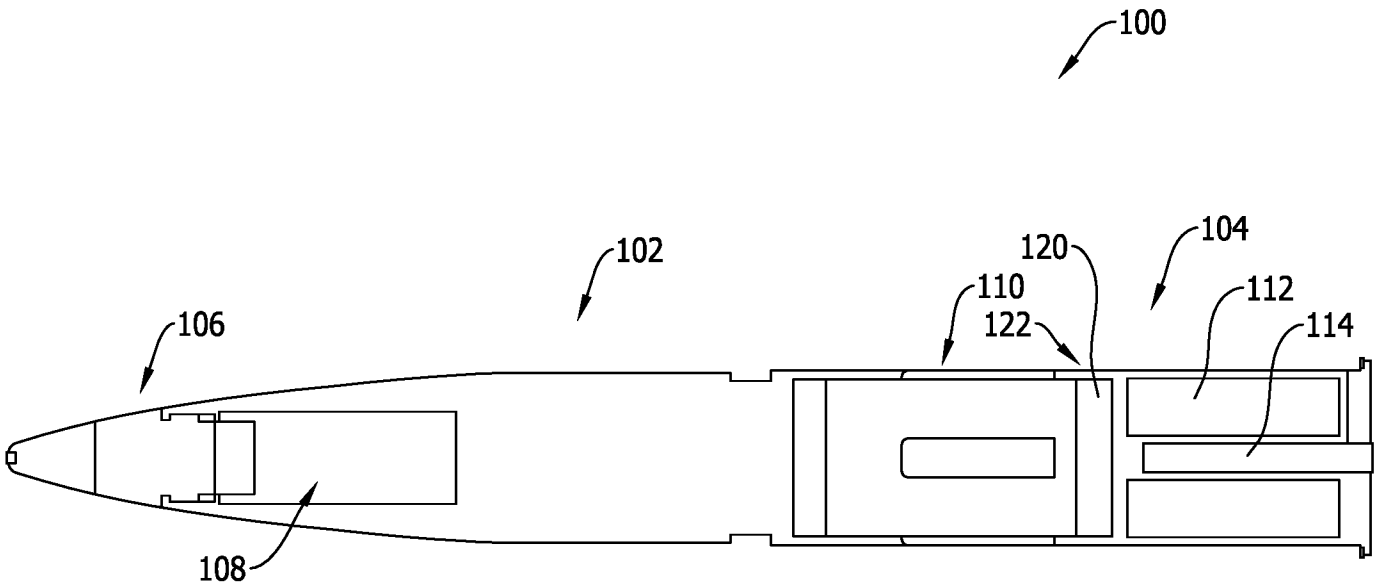
FIG. 1 is an internal schematic illustration of an exemplary guided projectile.

FIG. 1 is an internal schematic illustration of an exemplary guided projectile 100. In the exemplary implementation, guided projectile 100 includes a warhead case 102 and a cartridge case 104 coupled to warhead case 102. As will be described in more detail below, cartridge case 104 is separable from warhead case 102 when guided projectile 100 is discharged from a projectile launcher (not shown). Warhead case 102 includes a fuse 106 and a hollow cavity 108 for housing an ordinance (not shown). Guided projectile 100 also includes a tail kit assembly 110, propellant 112, and a charge primer 114 positioned within cartridge case 104. Tail kit assembly 110 is threadably coupled with warhead case 102. Moreover, cartridge case 104, having propellant 112 and charge primer 114 installed therein, is slidably coupled over tail kit assembly 110 and crimped onto warhead case 102.

In operation, guided projectile 100 is loaded into the projectile launcher, and guided projectile 100 is discharged therefrom. More specifically, the projectile launcher strikes charge primer 114, which activates propellant 112. Activating propellant 112 facilitates creating a high-pressure region within aft portion 118 of cartridge case 104. In some implementations, tail kit assembly 110 houses pressure-sensitive components, such as guidance avionics and control fin actuators (not shown in FIG. 1). As such, tail kit assembly 110 is fabricated to seal and protect the pressure-sensitive components from the high-pressure region during a discharge event.

Guided projectile 100 also includes a protective cap 120 positioned within aft portion 118 of cartridge case 104 at an aft end 122 of tail kit assembly 110. In one embodiment, protective cap 120 is integrated with tail kit assembly 110. Protective cap 120 is positioned between tail kit assembly 110 and propellant 112, and facilitates shielding tail kit assembly 110 from propellant 112 during the discharge event. As shown, protective cap 120 has a substantially cylindrical shape and extends no further than aft end 122 of tail kit assembly 110. As such, protective cap 120 does not restrict an internal volume of tail kit assembly 110. Exemplary materials for fabricating protective cap 120 include, but are not limited to, titanium, steel, and aluminum.

Figure 2:
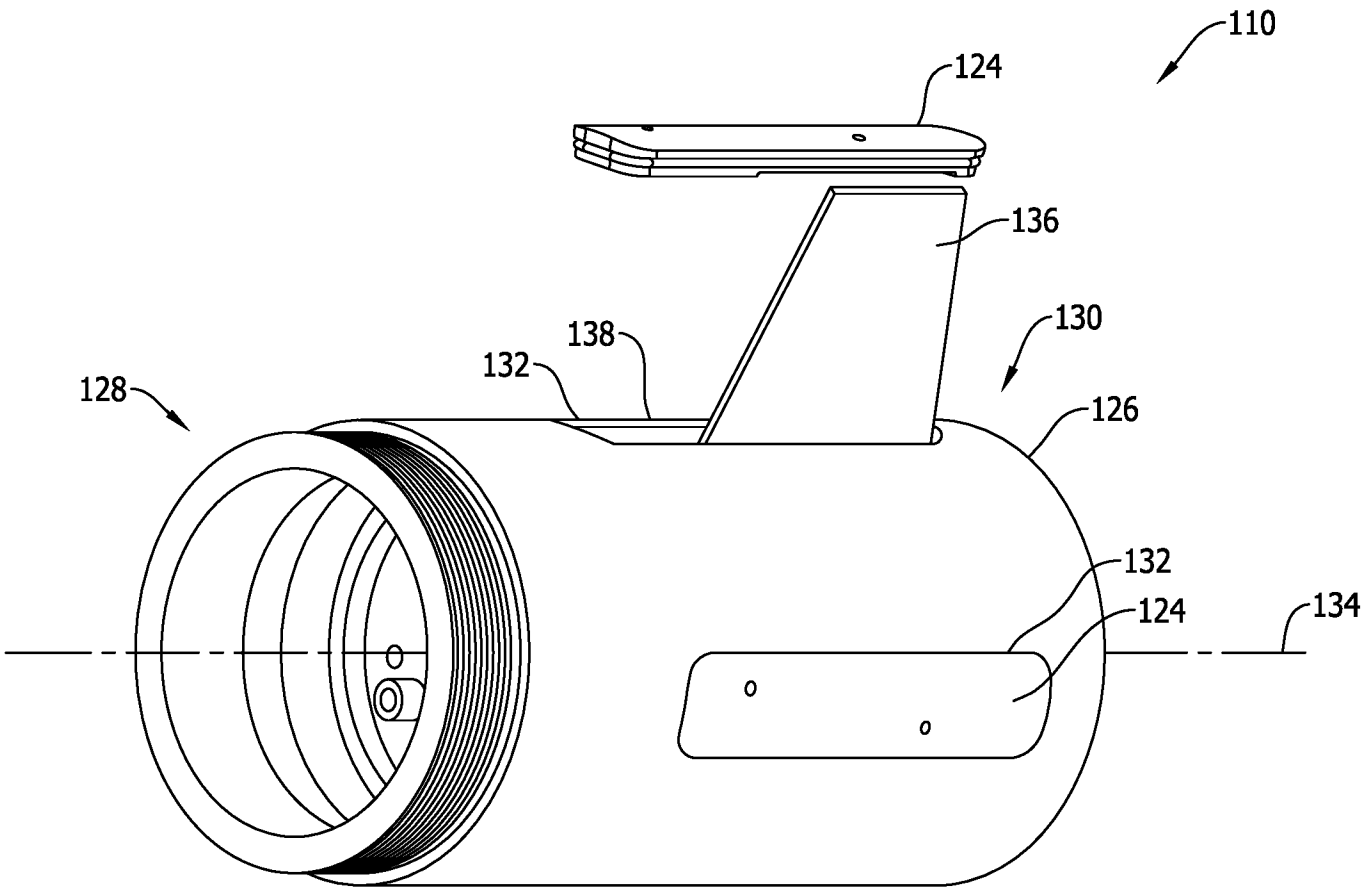
FIG. 2 is a perspective view of a partially deployed tail kit assembly that may be used in the guided projectile shown in FIG. 1.
Figure 3:
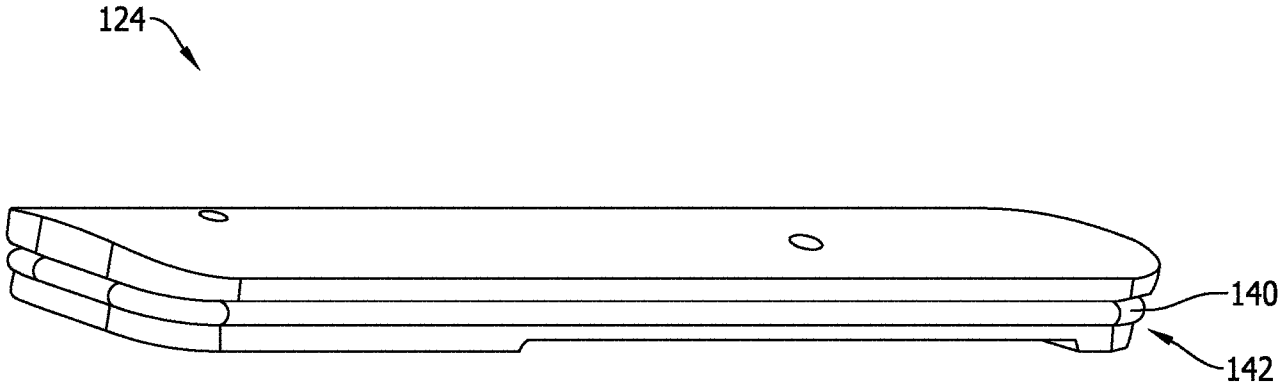
FIG. 3 is an enlarged perspective view of an exemplary fin slot cover that may be used with the tail kit assembly shown in FIG. 2.

FIG. 2 is a perspective view of a partially deployed tail kit assembly 110 that may be used in guided projectile 100 (shown in FIG. 1), and FIG. 3 is an enlarged perspective view of an exemplary fin slot cover 124 that may be used with tail kit assembly 110 (shown in FIG. 2). In the exemplary implementation, tail kit assembly 110 includes a hollow casing 126 including a forward end 128, and aft end 130, and a plurality of fin slots 132 defined therein at different circumferential positions relative to a centerline 134 of hollow casing 126. A control fin 136 is selectively extendable from within hollow casing 126 through each fin slot 132 of the plurality of fin slots 132. Any number of fin slots 132 may be defined within a side wall 138 of hollow casing 126 that enables guided projectile 100 to function as described herein. Moreover, while shown with only a single control fin 136 being deployed, a plurality of control fins 136 are housed within hollow casing 126 and deployable through the plurality of fin slots 132.

Tail kit assembly 110 also includes a fin slot cover 124 selectively positioned within each fin slot 132 with a minimum clearance fit such that fin slot cover 124 is retained within each fin slot 132, and such that control fin 136 is retained within hollow casing 126. Fin slot cover 124 is also releasable from within each fin slot 132 such that control fin 136 is deployable therethrough. More specifically, when tail kit assembly 110 is fully assembled, fin slot cover 124 is retained within each fin slot 132 with a predetermined retaining force as a result of fin slot cover 124 being sized to have a minimum clearance fit relative to the dimensions of fin slot 132. In one implementation, fin slot cover 124 is sized to have a minimum clearance fit (i.e., a gap between fin slot 132 and fin slot cover 124) defined within a range between about 0 inches and about 0.008 inches. More particularly, the minimum clearance fit is defined within a range between about 0.003 inches and 0.005 inches.

In some embodiments, as will be described in more detail below, guided projectile 100 is discharged from a launcher having a rifled barrel (not shown), such that guided projectile 100 rotates about centerline 134, thereby inducing a centrifugal force to fin slot cover 124. As such, fin slot cover 124 is positioned and oriented within fin slot 132 such that fin slot cover 124 is released from within each fin slot 132 when a centrifugal force greater than the retaining force is induced to fin slot cover 124. Moreover, providing a device that enables each control fin 136 to be individually retained within hollow casing 126 without the use of a tapered cup enables hollow casing 126 to have a cylindrical cross-sectional shape extending continuously between forward end 128 and aft end 130.

As described above, activating propellant 112 (shown in FIG. 1) facilitates creating a high-pressure region within aft portion 118 of cartridge case 104. More specifically, activating propellant 112 creates gun bore pressure that causes fin slot covers 124 to be held in place to seal the internal components within hollow casing 126. The gun bore pressure decreases as guided projectile 100 traverses a gun barrel, and the tail kit external pressure rapidly decreases upon gun muzzle egress. The rapid decrease in pressure in combination with centrifugal forces caused by rotation induced by the rifled barrel cause fin slot covers 124 to be released, and control fins 136 to deploy.

Referring to FIG. 3, fin slot cover 124 includes a flexible sealing member 140 (e.g., an o-ring) coupled thereto. More specifically, fin slot cover 124 includes a retaining groove 142 sized to receive flexible sealing member 140 therein, and retaining groove 142 extends about a periphery of fin slot cover 124. Flexible sealing member 140 facilitates sealing an internal volume of hollow casing 126 (shown in FIG. 2) through the plurality of fin slots 132 (shown in FIG. 2) from the high-pressure region during the discharge event. Flexible sealing member 140 also facilitates providing the retaining force for fin slot cover 124 within the plurality of fin slots 132. Flexible sealing member 140 is compressibly disposed between a portion of fin slot cover 124 and fin slot 132, thereby producing a predetermined retaining force greater than that required for projectile handling and loading, and less than that encountered during gun muzzle egress. In one implementation, the predetermined retaining force is greater than about 5 pounds. As such, fin slot cover 124 is sized relative to fin slot 132 to have a minimum clearance fit such that fin slot cover 124 and flexible sealing member 140 provide a compression fit that restricts movement of fin slot cover 124 out of fin slot 132, and that provides a predetermined retaining force greater than about 5 pounds. The predetermined retaining force is also selected to be less than that encountered during projectile gun muzzle egress. For example, in one implementation, the predetermined retaining force is less than about 190 pounds, which is typically induced centrifugally during gun muzzle egress.

Figure 4:
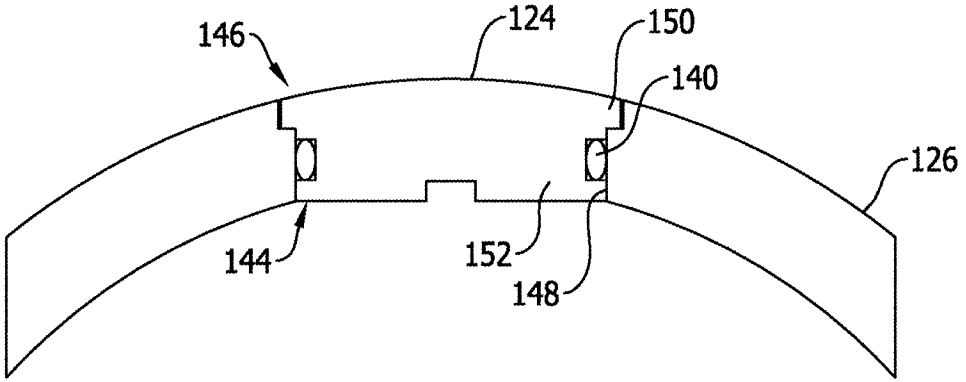
FIG. 4 is a schematic cross-sectional illustration of a portion of the tail kit assembly shown in FIG. 2.

FIG. 4 is a schematic cross-sectional illustration of a portion of tail kit assembly 110 (shown in FIG. 2). In the exemplary implementation, fin slot cover 124 is positioned within fin slot 132 with a minimum clearance fit. More specifically, fin slot 132 is formed with a counter-bored profile defining an inner radial opening 144 and an outer radial opening 146 having a larger cross-sectional profile than inner radial opening 144. Fin slot cover 124 has a complementary counter-bored shape such that fin slot cover 124 is positioned within fin slot 132 with the minimum clearance fit. As such, fin slot cover 124 is restricted from falling through inner radial opening 144 of fin slot 132.

In the exemplary implementation, flexible sealing member 140 is compressibly disposed between fin slot cover 124 and an inner side wall 148 of hollow casing 126. More specifically, flexible sealing member 140 is positioned relative to fin slot cover 124 and has a thickness such that flexible sealing member 140 is compressibly disposed against inner side wall 148. As such, fin slot cover 124 is held in place during guided projectile handling and loading by the compression of flexible sealing member 140. Moreover, external radial pressure support is provided by the hoop strength of hollow case 126, and by a stepped support flange 150 of fin slot cover 124.

In an alternative implementation, flexible sealing member 140 is assembled with hollow casing 126 rather than fin slot cover 124. In such an implementation, flexible sealing member 140 is retained within inner side wall 148, and a radially inner portion 152 of fin slot cover 124 is compressibly disposed against flexible sealing member 140 with the minimum clearance fit.

A method of enabling guidance of a guided projectile is also provided herein. The method includes loading the guided projectile into a projectile launcher. The guided projectile includes a hollow casing, a control fin selectively extendable from within the hollow casing through a fin slot defined in the hollow casing, and a fin slot cover positioned within the fin slot with a minimum clearance fit such that the control fin is retained within the hollow casing. The method also includes inducing a centrifugal force to the fin slot cover such that the fin slot cover is released from the hollow casing, and such that the control fin is deployed from within the hollow casing.

In one implementation, inducing a centrifugal force to the fin slot cover comprises discharging the guided projectile from the projectile launcher. Discharging the guided projectile includes discharging the guided projectile from the projectile launcher having a rifled barrel.

Moreover, inducing a centrifugal force to the fin slot cover comprises fully releasing the fin slot cover from the hollow casing such that the fin slot cover is foreign object debris.

This written description uses examples to disclose various implementations, including the best mode, and also to enable any person skilled in the art to practice the various implementations, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A guided projectile comprising:

a warhead case;

a cartridge case coupled to said warhead case; and a tail kit assembly positioned within said cartridge case, said tail kit assembly comprising:

a hollow casing comprising a plurality of fin slots defined therein;

a control fin selectively extendable from within said hollow casing through each fin slot of said plurality of fin slots; and a fin slot cover positioned within each fin slot with a minimum clearance fit such that said control fin is retained within said hollow casing, wherein said fin slot cover is releasable from within each fin slot such that said control fin is deployable therethrough;

wherein said tail kit assembly further comprises a flexible sealing member compressibly disposed between said fin slot cover and a portion of said hollow casing; and wherein said fin slot cover is sized relative to each fin slot to have the minimum clearance fit such that said fin slot cover and said flexible sealing member disposed between said fin slot cover and said each fin slot yield a compression fit for retaining said fin slot cover with a predetermined retaining force of at least 5 pounds.

2. The guided projectile in accordance with claim 1, wherein said fin slot cover is positioned such that said fin slot cover is configured for release from within each fin slot when a centrifugal force is induced to said fin slot cover.

3. The guided projectile in accordance with claim 1, wherein said fin slot cover comprises a retaining groove sized to receive said flexible sealing member therein, said retaining groove extending about a periphery of said fin slot cover.

4. The guided projectile in accordance with claim 3, wherein said flexible sealing member has a thickness such that said flexible sealing member and at least a portion of said fin slot cover have a larger profile than said opening of each fin slot.

5. The guided projectile in accordance with claim 1, wherein said hollow casing has a cylindrical cross-sectional shape extending continuously between a forward end and an aft end of said hollow casing.

6. The guided projectile in accordance with claim 5 further comprising a protective cap positioned at said aft end of said hollow casing.

7. A tail kit assembly for use with a guided projectile, said tail kit assembly comprising:

a hollow casing comprising a plurality of fin slots defined therein;

a control fin selectively extendable from within said hollow casing through each fin slot of said plurality of fin slots; and a fin slot cover positioned within each fin slot with a minimum clearance fit such that said control fin is retained within said hollow casing, wherein said fin slot cover is releasable from within each fin slot such that said control fin is deployable therethrough;

wherein said tail kit assembly further comprises a flexible sealing member compressibly disposed between said fin slot cover and a portion of said hollow casing; and wherein said fin slot cover is sized relative to each fin slot to have the minimum clearance fit such that said fin slot cover and said flexible sealing member disposed between said fin slot cover and said each fin slot yield a compression fit for retaining said fin slot cover with a predetermined retaining force of at least 5 pounds.

8. The assembly in accordance with claim 7, wherein said fin slot cover is positioned such that said fin slot cover is configured for release from within each fin slot when a centrifugal force is induced to said fin slot cover.

9. The assembly in accordance with claim 7, wherein said fin slot cover comprises a retaining groove sized to receive said flexible sealing member therein, said retaining groove extending about a periphery of said fin slot cover.

10. The assembly in accordance with claim 9, wherein said flexible sealing member has a thickness such that said flexible sealing member is compressibly disposed between said fin slot and said fin slot cover with a predetermined retaining force greater than that required for projectile handling and loading, and less than that encountered during gun muzzle egress.

11. The assembly in accordance with claim 7, wherein said hollow casing has a cylindrical cross-sectional shape extending continuously between a forward end and an aft end of said hollow casing.

12. The assembly in accordance with claim 11 further comprising a protective cap positioned at said aft end of said hollow casing.

13. A method of enabling guidance of a guided projectile, said method comprising:

providing the guided projectile of claim 1;

loading the guided projectile into a projectile launcher; and inducing a centrifugal force to the fin slot cover such that the fin slot cover is released from the hollow casing, and such that the control fin is deployed from within the hollow casing.

14. The method in accordance with claim 13, wherein inducing a centrifugal force to the fin slot cover comprises discharging the guided projectile from the projectile launcher.

15. The method in accordance with claim 14, wherein discharging the guided projectile comprises discharging the guided projectile from the projectile launcher having a rifled barrel.

16. The method in accordance with claim 13, wherein inducing a centrifugal force to the fin slot cover comprises releasing the fin slot cover from the hollow casing such that the fin slot cover is foreign object debris.

* * * * *